US006857883B2

(12) United States Patent
Tang

(10) Patent No.: US 6,857,883 B2
(45) Date of Patent: Feb. 22, 2005

(54) PROJECTOR LIGHT DEVICE HAVING A SOLID STRUCTURE

(75) Inventor: Shih Chuan Tang, Chong Ho (TW)

(73) Assignee: Tons Enterprise Co., LTD, Taipei (TW)

( * ) Notice: Subject to any disclaimer, the term of this patent is extended or adjusted under 35 U.S.C. 154(b) by 228 days.

(21) Appl. No.: 10/163,820

(22) Filed: Jun. 3, 2002

(65) Prior Publication Data

US 2003/0223234 A1 Dec. 4, 2003

(51) Int. Cl.[7] ..... H01R 25/00
(52) U.S. Cl. ..... 439/116
(58) Field of Search ..... 439/116, 122, 439/118

(56) References Cited

U.S. PATENT DOCUMENTS 3,503,032 A * 3/1970 Routh et al. ..... 439/94
3,718,886 A * 2/1973 Hoffmeister ..... 439/122
4,032,208 A * 6/1977 Berkenhoff ..... 439/122
4,676,567 A * 6/1987 Mouchi ..... 439/207
4,919,625 A * 4/1990 Coutre ..... 439/118
5,603,622 A * 2/1997 Lin ..... 439/121

* cited by examiner

*Primary Examiner*—Phuong Dinh

(57) ABSTRACT

A projector light device includes two or more conductor bars received in a track, a pedestal slidably engaged in the track, two or more conductors secured in the pedestal and each having a flap engageable into the track for electrically contacting with the conductor bars. A projector light member is attached to the pedestal and electrically coupled to the conductors. An actuator device is rotatably received in the pedestal and has an actuator for forcing the flaps of the conductors to engage with the conductor bars when the actuator device is rotated relative to the pedestal.

11 Claims, 5 Drawing Sheets

PROJECTOR LIGHT DEVICE HAVING A SOLID STRUCTURE

BACKGROUND OF THE INVENTION

1. Field of the Invention

The present invention relates to a projector light device, and more particularly to a projector light device having a solid coupling structure.

2. Description of the Prior Art

Typical projector light devices may include one or more projector light members attached to a track. However, the projector light members may not be solidly secured to the track, and may not be solidly coupled to the electric power source.

The present invention has arisen to mitigate and/or obviate the afore-described disadvantages of the conventional projector light devices.

SUMMARY OF THE INVENTION

The primary objective of the present invention is to provide a projector light device including a solid coupling structure for solidly and slidably attaching the projector light members to the track.

In accordance with one aspect of the invention, there is provided a projector light device comprising a track including a passage and a pair of channels communicating with each other, two conductor bars secured in the channels of the track for coupling to electric power source, a pedestal slidably engaged in the passage of the track, two first conductors secured in the pedestal, and each including a flap extendible outward of the pedestal and engageable into the channels of the track for electrically contacting with the conductor bars, a projector light member attached to the pedestal, and electrically coupled to the first conductors, and means for selectively actuating the flaps of the first conductors to engage with the conductor bars respectively, and to electrically couple the projector light member to the conductor bars.

The pedestal includes a base having a barrel, the projector light member includes a coupler secured to the barrel, for attaching to the pedestal. The pedestal includes a space and an orifice communicating with each other for receiving the base and the barrel. The barrel is preferably a threaded barrel for threading with the coupler of the projector light member.

The pedestal includes an opening, the first conductors each includes a seat received in the opening of the pedestal, the projector light member includes two electric wires secured to the seats with fasteners.

The selectively actuating means includes an actuator device rotatably received in the pedestal and having an actuator element selectively engaged with the first conductors, for forcing the flaps of the first conductors to engage with the conductor bars when the actuator device is rotated relative to the pedestal.

The actuator device includes a post, and the actuator element is extended from the post. The actuator device includes a knob provided thereon for rotating the actuator device relative to the pedestal.

A plug is further provided and slidably received in the passage of the track, and includes a pair of conductors provided thereon and slidably engaged with the conductor bars respectively.

The plug includes a pair of bulges laterally extended therefrom and slidably engaged into the channels of the track respectively, and the conductors of the plug are provided on the bulges respectively.

The track includes a groove formed therein and communicating with the passage thereof, another conductor bar is secured in the groove of the track, the pedestal includes another conductor secured therein and having a flap extendible outward of the pedestal and engageable into the groove of the track for grounding purposes.

The actuator device includes another actuator element selectively engaged with the conductor, for forcing the flap of the conductor to engage with the second conductor bar when the actuator device is rotated relative to the pedestal.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
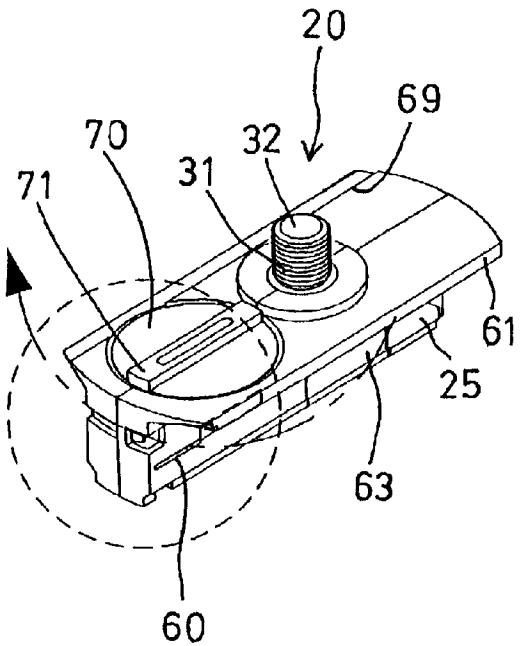
FIG. 2 is a perspective view of a pedestal of the projector light device for coupling a projector light member to a track.

Referring to the drawings, and initially to FIGS. 1 and 6–8, a projector light device in accordance with the present invention comprises a track 10 including a longitudinal passage 11 formed therein, and a pair of channels 12, 13 oppositely formed therein and communicating with the longitudinal passage 11 thereof, and a groove 14 selectively formed therein, such as formed on one side thereof, and offset from the channels 12, 13 thereof. Three longitudinal conductor bars 15, 16, 17 are engaged and secured in the channels 12, 13 and in the groove 14 of the track 10 respectively.

As shown in FIGS. 2–6, one or more pedestals 20 may be slidably engaged into the longitudinal passage 11 of the track 10. However, for clearly illustrating purposes, only one of the pedestals 20 is shown. The pedestal 20 may include two or more parts or half members 21, 22 secured together with one or more fasteners 23. For example, one fastener 23 is engaged through one member 22, and secured to a stud 24 of the other member 21, for detachably securing the members 21, 22 together. The pedestal 20 may selectively or optionally include one or more ribs or projections 25 (FIGS. 2, 5, 9, 11) laterally extended therefrom for slidably engaging with the channels 12, 13 or the groove 14 of the track 10, for allowing the pedestal 20 to be slidably and stably coupled or secured to the track 10. The sliding engagement of the projections 25 with the track 10 may thus form a securing means for slidably securing the pedestal 20 to the track 10.

The pedestal 20 includes a non-circular, such as a hexagonal space 26 and an orifice 27 formed therein and communicating with each other. A non-circular, such as a hexagonal base 30 is received and secured in the space 26 of the pedestal 20, and includes a threaded barrel 31 extended outward through the orifice 27 of the pedestal 20, and includes a bore 32 formed through the base 30 and the barrel 31 for receiving one or more electric wires 33, 34, 35 therein. A projector light member 36 includes a rod 37 having a coupler 38 provided on one end (FIG. 1) for threading or coupling to the barrel 31, and thus for detachably securing the projector light member 36 to the pedestal 20.

The pedestal 20 includes one or more, such as three slots 28 formed therein, and formed or defined by one or more ribs or partitions 29 provided or extended therein. Three conductors 40, 41, 42 are received and retained or secured in the slots 28 of the pedestal 20 respectively, and each includes a seat 43, 44, 45 formed or provided on one end thereof for coupling to the electric wires 33, 34, 35 with fasteners 46 respectively, and each includes a flap 47, 48, 49 bent from the other end thereof and extendible outward through the slits 60 (FIG. 3) of the pedestal 20 and engageable into the channels 12, 13 and the groove 14 of the track 10 respectively (FIGS. 2, 3, 5, 9, 10).

The pedestal 20 preferably includes one or more flanges 61 extended laterally outward therefrom, for engaging with the track 10, and for further stably securing the pedestal 20 to the track 10. The pedestal 20 may include an opening 62 formed therein (FIG. 3), such as formed in the half member 22 thereof, for exposing or for receiving the seats 43, 44, 45 and the fasteners 46, and for allowing the electric wires 33, 34, 35 to be secured to the conductors 40, 41, 42 with the fasteners 46, via the opening 62 of the pedestal 20, without disengaging the half members 21, 22 from each other. A cap 63 may be secured to the pedestal 20 with one or more fasteners 64 for blocking the opening 62 of the pedestal 20.

The pedestal 20 includes a depression 66 formed in the upper portion thereof, and an aperture 67 formed therein and communicating with the depression 66 and the slots 28 of the pedestal 20. An actuator device 70 is further provided and includes a knob 71 provided on top thereof for rotating the actuator device 70 relative to the pedestal 20, and includes a post 72 extended therefrom for rotatably engaged through the aperture 67 and the slots 28 of the pedestal 20. The actuator device 70 may include a stop 73 (FIG. 4) extended from the post 72 and received in the pedestal 20 and engaged with pedestal 20 for rotatably securing the actuator device 70 to the pedestal 20.

As best shown in FIGS. 3, 4, 9 and 10, the actuator device 70 includes one or more, such as two cams or actuator elements 74, 76 extended from or attached to or provided on the post 72, for selectively engaging with the conductors 40, 41, 42. As shown in FIGS. 2, 6, 7, and 9, when the actuator device 70 has not been rotated, or has been rotated to a non-working position, or when the knob 71 is extended or aligned with or parallel to the longitudinal direction of the track 10, the actuator elements 74, 76 do not engaged with or do not force the flaps 47, 48, 49 of the conductors 40, 41, 42 outward of the pedestal 20.

As shown in FIGS. 1, 5, 8, and 11, when the actuator device 70 has been rotated for 90 degrees, or has been rotated to a working position, or when the knob 71 is perpendicular to the longitudinal direction of the track 10, the actuator elements 74, 76 may be forced to engage with the conductors 40, 41, 42, and thus to force the flaps 47, 48, 49 of the conductors 40, 41, 42 outward of the pedestal 20 and into the channels 12, 13 and the groove 14 of the track 10 respectively, and thus to electrically contact the flaps 47, 48, 49 with the conductor bars 16, 15, 17 respectively. Accordingly, the actuator elements 74, 76 of the actuator device 70 may form an actuating or forcing means to selectively actuate or to force the flaps 47, 48, 49 to electrically contact with the conductor bars 16, 15, 17 respectively.

It is to be noted that the pedestal 20 may further be solidly secured to the track 10 when the flaps 47, 48, 49 of the conductors 40, 41, 42 are engaged into the channels 12, 13 and the groove 14 of the track 10 respectively. The engagements of the flaps 47, 48 of the conductors 40, 41 with the conductor bars 16, 15 are provided for electrically coupling purposes. The conductor bar 17 and the flap 49 and the conductor 42 are provided for such as the grounding purposes, and may be removed when grounding is not required.

The track 10 includes a mark, such as a longitudinal line shaped mark 18 applied or provided thereon, and located on the side where the groove 14 and the conductor bar 17 are located. The pedestal 20 may also include a mark, such as a longitudinal line shaped mark 69 applied or provided thereon, and located on the side where the conductor 42 and the flap 49 are located. The conductor 42 and the flap 49 may thus be disposed close to the groove 14 of the track 10, for allowing the flap 49 of the conductor 42 to be engaged into the groove 14 of the track 10.

Figure 1:
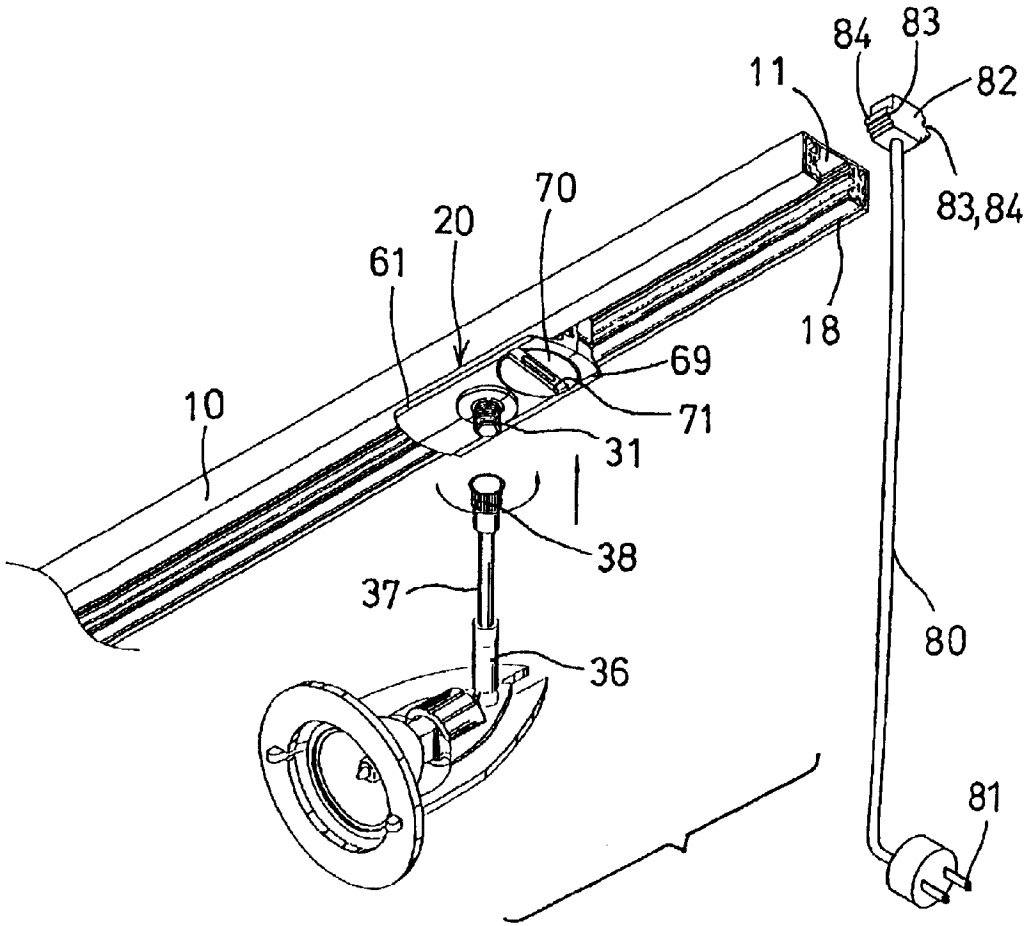
FIG. 1 is a partial exploded view of a projector light device in accordance with the present invention.
Figure 3:
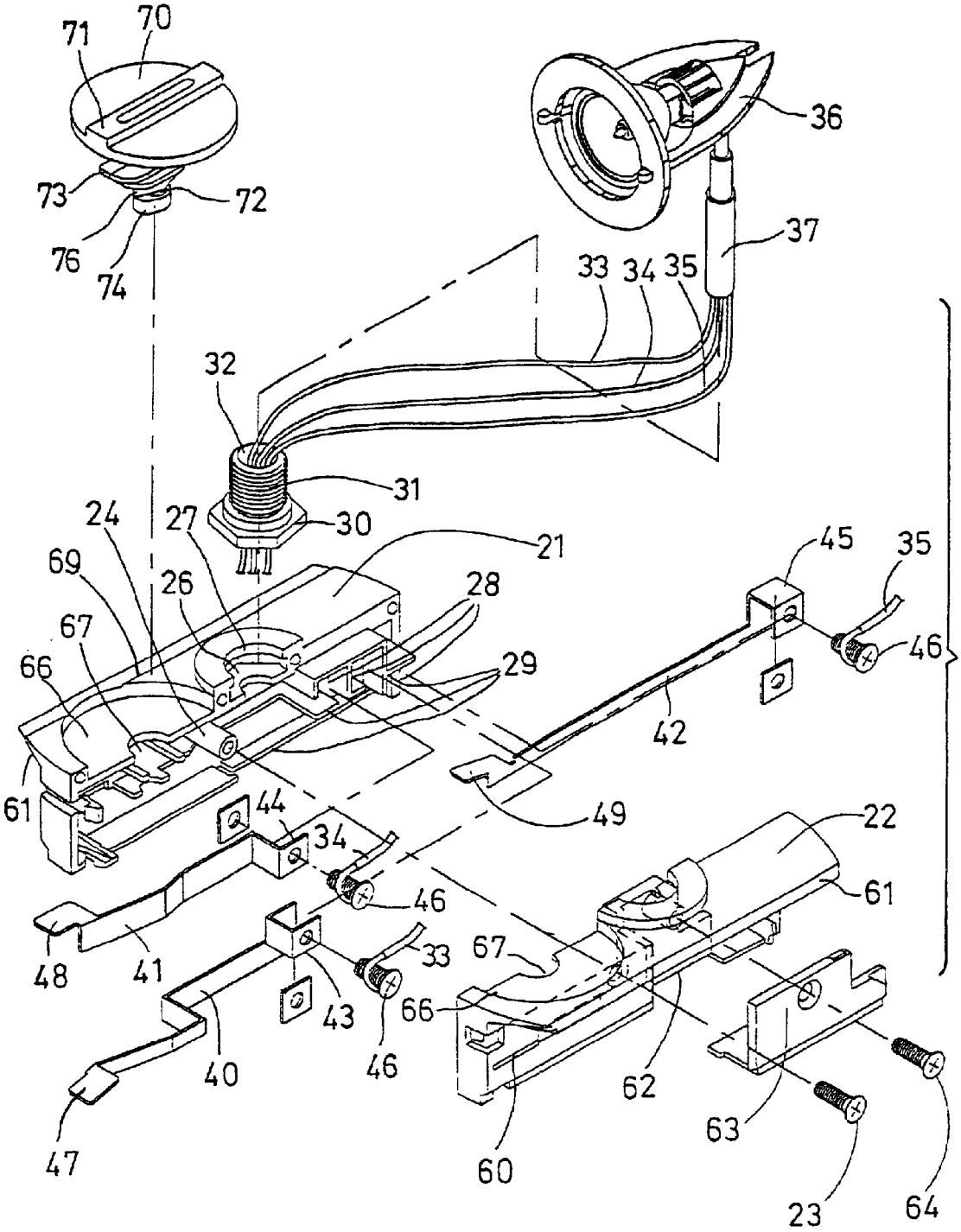
FIG. 3 is an exploded view of the pedestal of the projector light device.
Figure 4:
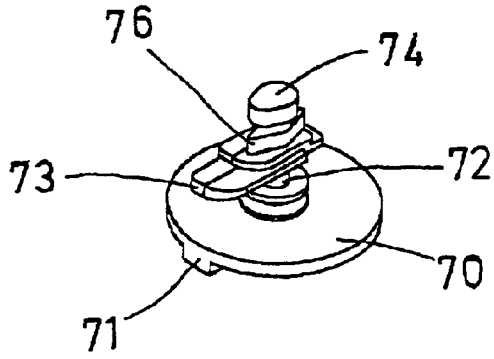
FIG. 4 is a bottom perspective view of an actuator device of the projector light device.
Figure 5:
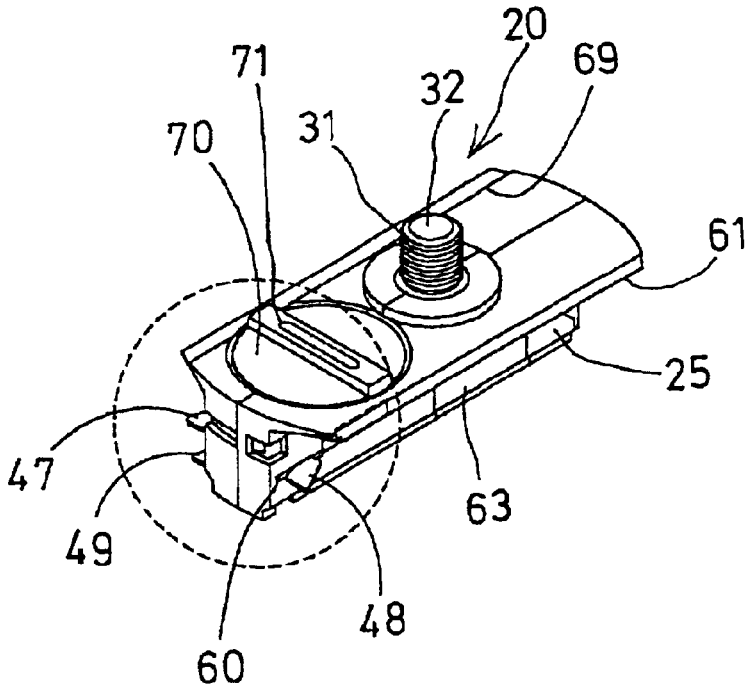
FIG. 5 is a perspective view illustrating the operation of the pedestal.
Figure 6:
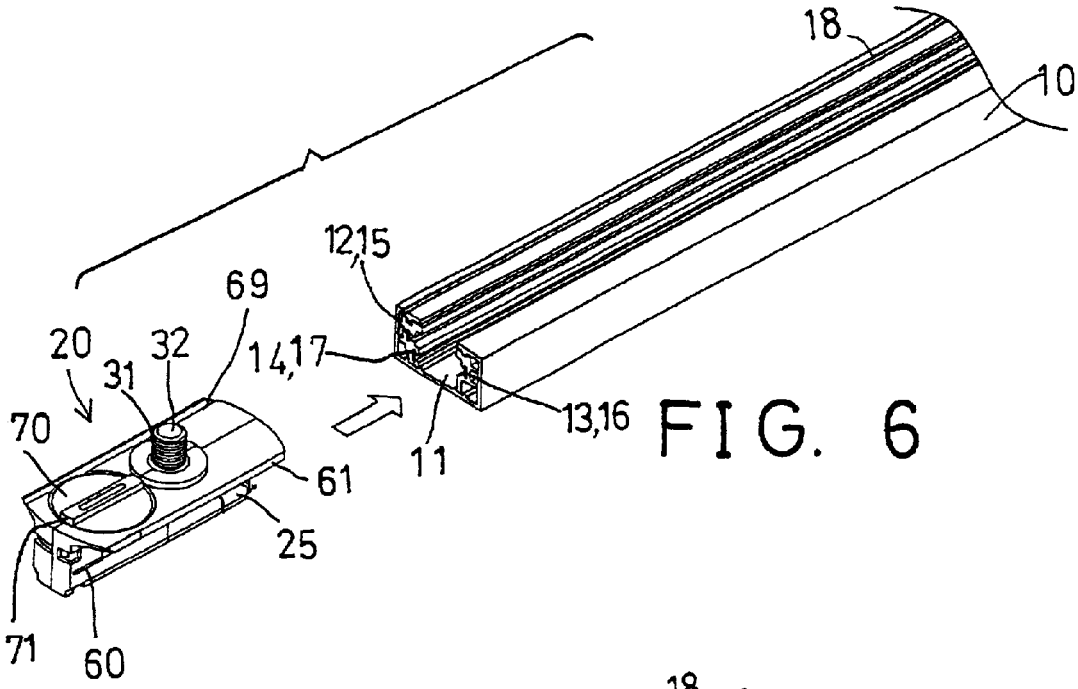
FIG. 6 is an exploded view illustrating the attachment or the assembling of the pedestal to the track of the projector light device.
Figure 7:
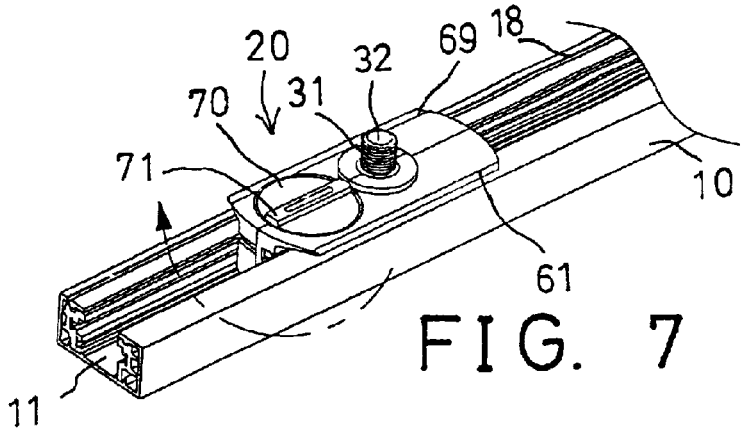
FIGS. 7, 8 are perspective views illustrating the operation or the assembling of the projector light device.
Figure 8:
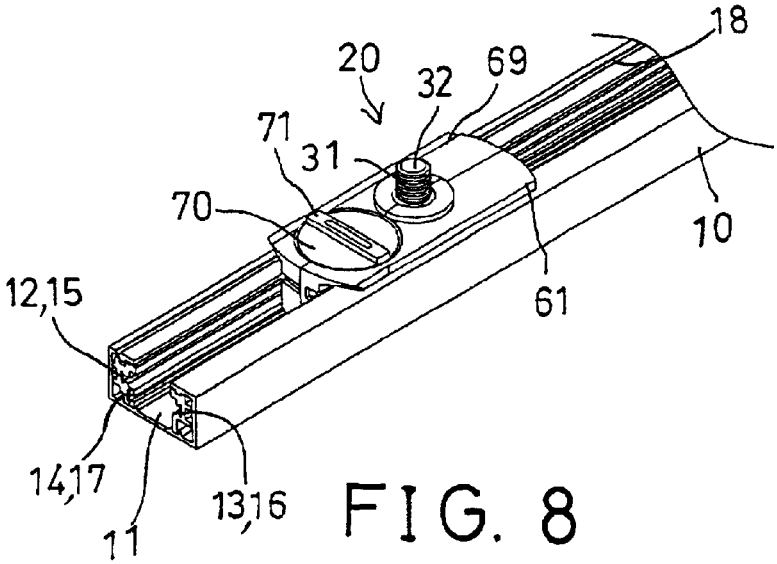
Figure 10:
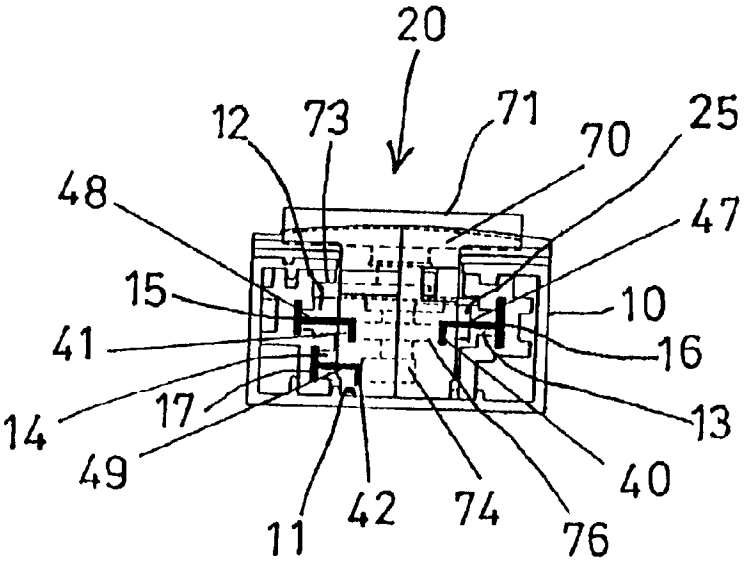
FIGS. 9, 10 are end schematic views illustrating the operation of the projector light device.
Figure 9:
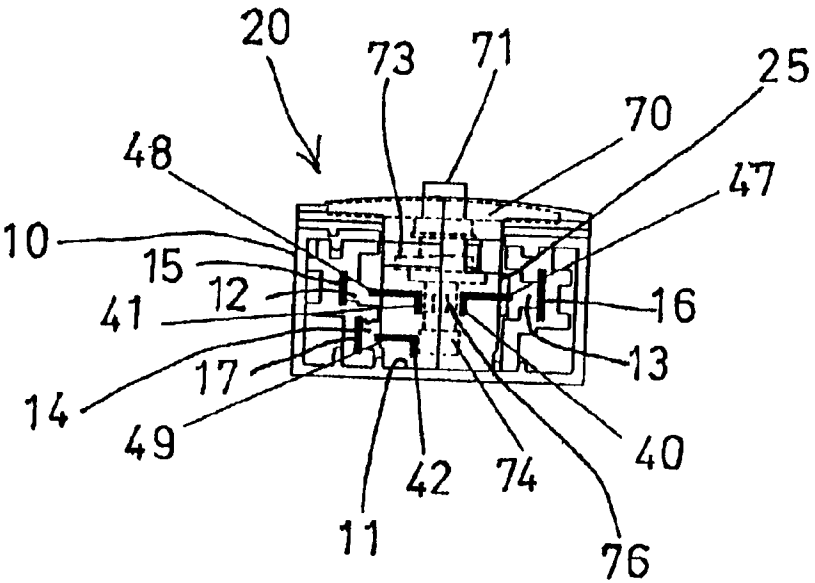

As shown in FIG. 1, an electric wire 80 includes a plug 81 attached to one end for coupling to the electric power source, for receiving the electricity from the electric power source, and includes a coupler or another plug 82 attached to the other end thereof and slidably engaged in the passage 11 of the track 10. The plug 82 includes one or more, such as three bulges 83 laterally extended therefrom, for slidably engaging into the channels 12, 13 and the groove 14 of the track 10 respectively.

The electric wire 80 includes one or more, such as three conductors 84 attached to or extended from the bulges 83 for electrically contacting or engaging with the conductor bars 15, 16, 17 of the track 10 respectively, and for allowing the electric power to be supplied from the electric wire 80 and the conductors 84 to the conductor bars 15, 16 and then to the projector light member 36 via the conductors 40, 41. The flaps 47, 48 of the conductors 41, 40 may be disengaged from the conductor bars 15, 16 when the actuator device 70 is rotated to the non-working position as shown in FIGS. 2, 6, 7, 9.

Accordingly, the projector light device in accordance with the present invention includes a solid coupling structure for solidly and slidably attaching the projector light members to the track.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A projector light device comprising:

a track including a passage and a pair of channels formed therein and communicating with each other, a pair of conductor bars secured in said channels of said track respectively for coupling to electric power source, a pedestal slidably engaged in said passage of said track, a pair of first conductors secured in said pedestal, and each including a flap extendible outward of said pedestal and engageable into said channels of said track for electrically contacting with said conductor bars respectively, a projector light member attached to said pedestal, and electrically coupled to said first conductors respectively, and means for selectively actuating said flaps of said first conductors to engage with said conductor bars respectively, and to electrically couple said projector light member said conductor bars, said selectively actuating means including an actuator device rotatably received in said pedestal and having an actuator element selectively engaged with said first conductors, for forcing said flaps of said first conductors to engage with said conductor bars respectively when said actuator device is rotated relative to said pedestal.

2. The projector light device according to claim 1, wherein said pedestal includes a base secured therein and having a barrel extended therefrom, said projector light member includes a coupler secured to said barrel, for attaching said projector light member to said pedestal.

3. The projector light device according to claim 2, wherein said pedestal includes a space and an orifice formed therein and communicating with each other, said base is received in said space of said pedestal, and said barrel is extended through said orifice of said pedestal.

4. The projector light device according to claim 2, wherein said barrel is a threaded barrel, said coupler of said projector light member is threaded and secured to said threaded barrel.

5. The projector light device according to claim 1, wherein said pedestal includes an opening formed therein, said first conductors each includes a seat received in said opening of said pedestal, said projector light member includes two electric wires secured to said seats with fasteners.

6. The projector light device according to claim 1, wherein said actuator device includes a post extended therefrom, said actuator element is extended from said post.

7. The projector light device according to claims 1, wherein said actuator device includes a knob provided thereon for rotating said actuator device relative to said pedestal.

8. The projector light device according to claim 1, wherein said track includes a groove formed therein and communicating with said passage thereof, a second conductor bar is secured in said groove of said track, said pedestal includes a second conductor secured therein and having a flap extendible outward of said pedestal and engageable into said groove of said track for grounding purposes.

9. The projector light device according to claim 8, wherein said actuator element of said actuator device is selectively engaged with said second conductor, for forcing said flap of said second conductor to engage with said second conductor bar when said actuator device is rotated relative to said pedestal.

10. The projector light device according to claim 8 further comprising a plug slidably received in said passage of said track, and including a third conductor provided thereon and slidably engaged with said second conductor bar.

11. The projector light device according to claim 10, wherein said plug includes a bulge laterally extended therefrom and slidably engaged into said groove of said track, and said third conductor is provided on said bulge.

* * * * *